United States Patent [19]

Groner

[11] 4,178,905

[45] Dec. 18, 1979

[54] COMPOUND BOW ADJUSTMENT AND INDICATING MECHANISM

[75] Inventor: Norman A. Groner, Kalkaska, Mich.

[73] Assignee: Victor United, Inc., Chicago, Ill.

[21] Appl. No.: 829,488

[22] Filed: Aug. 31, 1977

Related U.S. Application Data

[62] Division of Ser. No. 619,370, Nov. 10, 1975, Pat. No. 4,061,124.

[51] Int. Cl.[2] ..... F41B 5/00

[52] U.S. Cl. ..... 124/23 R; 116/294; 116/312

[58] Field of Search ..... 124/88, 90, 86, 24 R, 124/23 R, 80, 25; 43/6, 19; 116/294, 312

[56] References Cited

U.S. PATENT DOCUMENTS

| | | | |
|---|---|---|---|
| 1,434,768 | 11/1922 | Boggess | 43/19 |
| 3,744,473 | 7/1973 | Nishioka | 124/24 R |
| 3,841,295 | 10/1974 | Hunter | 124/88 X |
| 3,945,368 | 3/1976 | Jones | 124/86 X |
| 3,958,551 | 5/1976 | Ketchum | 124/90 X |
| 3,989,026 | 11/1976 | Nishioka | 124/88 X |
| 4,005,696 | 2/1977 | Jennings | 124/90 |

FOREIGN PATENT DOCUMENTS

| | | | |
|---|---|---|---|
| 131563 | 2/1949 | Australia | 43/19 |

*Primary Examiner*—Richard C. Pinkham
*Assistant Examiner*—William R. Browne
*Attorney, Agent, or Firm*—Emory L. Groff, Jr.

[57] ABSTRACT

A compound bow having limb members adjustably pivotally mounted on opposite ends of a handle member by a limb adjustment assembly including an arcuate rib and groove connection and an adjustable bolt fixedly holding the limb members in various adjusted positions relative to the handle member; a cable adjustment assembly mounted on an inner end portion of each limb member having a rotatable shaft member upon which an end of a cable may be adjustably wound and unwound to change the effective length of the cable with a ratchet mechanism to hold the shaft member in an adjusted position; an idler pulley assembly mounted on each limb member adjacent the outer end thereof and being pivotally mounted for inward and outward movement along the limb members and being rotatably mounted for rotation about an axis inclined to the limb members; and an eccentric wheel assembly mounted on the tips of each limb member, there being interrelated cooperatively located markings associated with the limb adjustment wheel assembly to enable tuning and timing relationships to be established.

9 Claims, 11 Drawing Figures

COMPOUND BOW ADJUSTMENT AND INDICATING MECHANISM

This is a division of application Ser. No. 619,370, filed Nov. 10, 1975, now U.S. Pat. No. 4,061,124.

BACKGROUND AND SUMMARY OF INVENTION

This invention relates to archery bows and more particularly, to compound-type archery bows employing cables, cams, and pulleys.

While compound-type bows have been known for some time, such bows have not been fully accepted by archers for many reasons among which are difficulties in achieving and maintaining satisfactory operation and performance of such bows. Compound bows utilize relatively complicated mechanisms which must be operated in unison in predetermined cooperative relationship in order to achieve and maintain satisfactory operational characteristics commonly referred to, at least in part, as tuning and timing characteristics. In addition, compound bows have been rather unsightly with various appendages detracting from the appearance of such bows.

A primary objective of the present invention is to provide a compound bow which is reliable in operation and the operational characteristics of which may be relatively easily adjusted to suit the individual needs and preferences of archers. Another objective is to provide a compound bow having simplified components which are integrated with the basic bow structure to provide a more pleasing appearance while at the same time streamlining the bow to avoid protuberances which make the bow unnecessarily unwieldy in handling and usage, particularly in use for hunting. Another objective is to provide adjustment apparatus by which the positions of various adjustable parts may be correlated and adjustments, as well as replacements of various parts, easily accurately accomplished.

The foregoing and other objectives have been attained by the provision of new and improved adjustable mounting means for adjustably mounting limb members on a handle member including an arcuate rib and socket connection with an adjustment bolt member associated with curved load bearing surfaces with associated indicia providing a reliable indication of adjustments; adjustable cable mounting means for adjusting the effective length of a cable by winding and unwinding one end of the cable on a rotatable shaft having a releasable ratchet mechanism and associated indicia providing a reliable indication of adjustments; cable pulley mounting means enabling easy adjustment of effective cable lengths while providing good operational characteristics; and eccentric wheel assembly means enabling easy adjustment and replacement while providing good operational characteristics with associated indicia providing a reliable indication of adjustments.

BRIEF DESCRIPTION OF DRAWING

A presently preferred and illustrative form of the invention is shown in the accompanying drawing in which.

Figure 1:
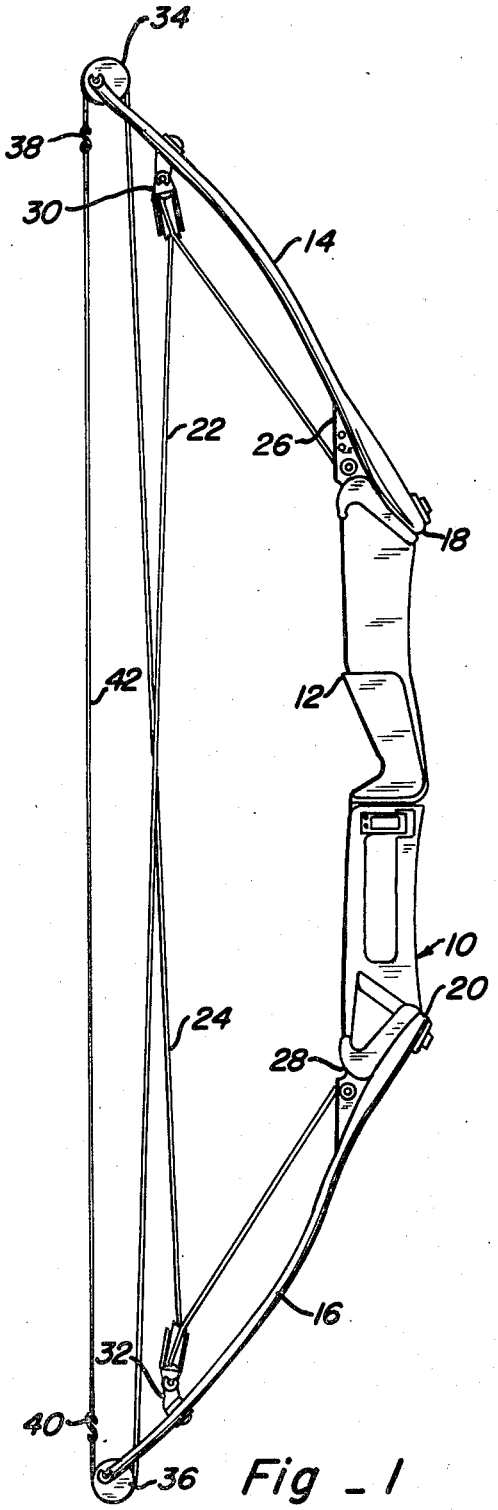
FIG. 1 is a side elevational view of a compound bow.

In general, as shown in FIG. 1, a compound bow 10, embodying illustrative presently preferred forms of the invention, comprises a handle member 12, which may be made of cast metal; a pair of limb members 14, 16; adjustable limb mounting assembly means 18, 20 on the opposite ends of the handle member and on the inner ends of the limb members; a pair of cable members 22,24; adjustable cable attachment assembly means 26, 28 fixedly mounted on inner end portions of the limb members; a pair of cable receiving idler pulley assembly means 30, 32 fixedly mounted on the outer end portions of the limb members; a pair of cable receiving eccentric wheel means assemblies 34, 36 fixedly mounted on the outer end portions of the limb members; and a pair of S-hook cable attachment members 38, 40 connecting the cable to a drawstring member 42.

Figure 2:
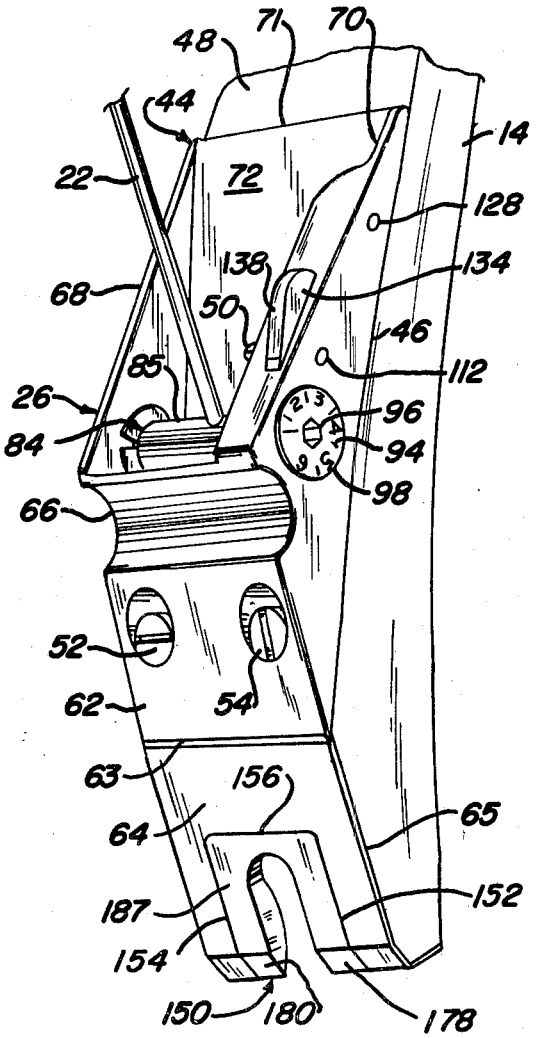
FIG. 2 is an enlarged perspective view of a cable adjustment assembly of the bow of FIG. 1.
Figure 3:
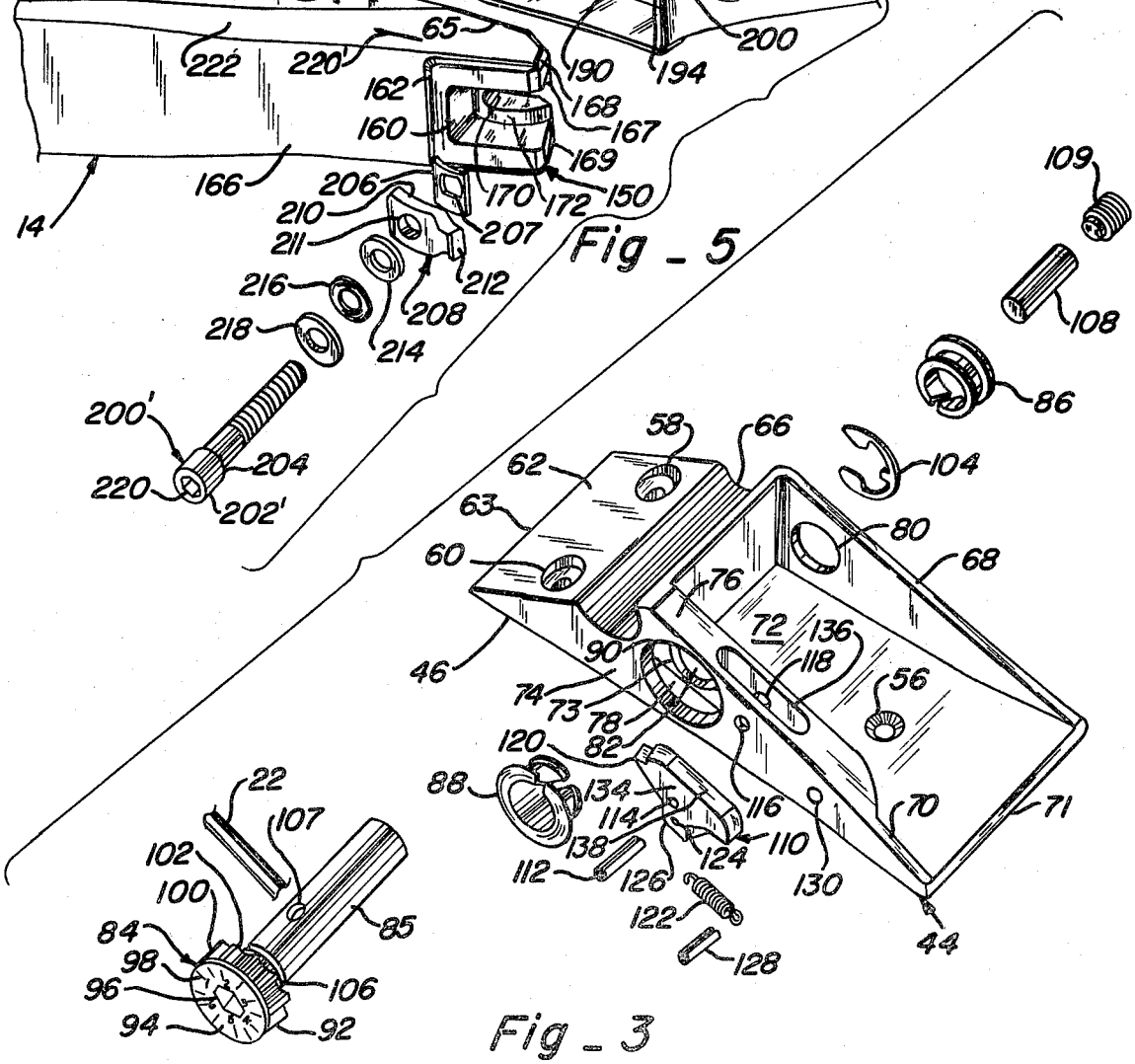
FIG. 3 is an enlarged exploded perspective view of the apparatus of FIG. 2.

Referring now to FIGS. 2–3, each of the adjustable cable attachment assembly means 26, 28 comprises a base plate member 44, which may be of cast metallic material, having a flat base surface 46 adapted to be abuttingly fixedly supported on a corresponding flat surface 48 on the inner end portion of the limb members by screw members 50, 52, 54 mounted in counter-sunk screw holes 56, 58, 60. An outwardly inclined abutment surface 62 at the inner end 63 of the plate member 44 extends at the same angle as the adjoining inclined surface 64 an end plate 65 on the inner end of the limb member. A pivotable limb support means in the form of a semi-circular groove 66 extends transversely thereacross such that the plane of surface 62 is diametrically related to groove 66. A pair of spaced parallel inclined flange portions 68, 70 extend outwardly from the outer end 71 of the plate member and intersect surface 62 adjacent groove 66 to define a cable channel 72 therebetween. Flange portion 70 has spaced inner and outer wall portions 73, 74 connected by an outer wall portion 76 to define a housing cavity 78. A pair of axially aligned bores 80, 82 in flange portion 68 and inner wall portion 73 of flange portion 70 rotatably support a ratchet wheel shaft member 84 with shaft portion 85 being received in plastic bearing sleeves 86, 88 mounted in bores 80, 82. An enlarged bore 90 in outer wall portion 74 of flange portion 70, coaxial with bores 80, 82, is adapted to receive a ratchet wheel portion 92 of member 84. A flat annular outer surface 94, a polygonal bore 96 coaxial with the shaft portion 85 and adapted to receive an adjustment tool (not shown) such as an Allen wrench, and indicia and markings 98 on the outer surface 94 of member 84 are located flush with the outer surface of flange portion 70 in the assembled position of FIG. 2. Ratchet means are provided on the periphery of wheel portion 92 adjacent outer surface 94 in the form of a plurality of relatively closely spaced alternating ribs 100 and grooves 102, there being 12 of each in the presently preferred embodiment. A retainer ring member 104 is mounted on a shoulder 106 on member 84 to hold the member 84 in the assembled position of FIG. 2. A transverse bore 107 in shaft portion 85 is adapted to receive the end of the cable member, as shown in FIG. 2, which is fixedly secured thereto by a plunger member 108 and set screw 109 mounted in shaft portion 85 and wound on the shaft portion in the assembled position. A ratchet dog member 110 is pivotally mounted in housing cavity 78 by a pin member 112 extending through a bore 114 in member 110 and axially aligned bores 116, 118 in wall portions 73, 74. A tapered protrusion 120 on one end of member 110 is received in the grooves 102 for abutting engagement with lugs 100. A tension spring member 122 located in housing cavity 78 is connected at one end to a spring attachment hole 124 in a depending lug portion 126 of member 110 and at the other end to a spring attachment pin 128 mounted in axially aligned bores 130 in wall portions 73, 74 to bias the protrusion 120 into restraining engagement with lugs 100. The mounting arrangement is such that an outer elongated portion 134, FIG. 2, of member 110, protrudes outwardly through an elongated slot 136 in wall portion 76 with an elongated flat outer surface 138 providing a pressure surface for receiving digitally applied force to pivot member 110 on shaft 112 against the bias of spring 122 to release member 84 by disengaging movement of protrusion 120 relative to lugs 100.

Figure 11:
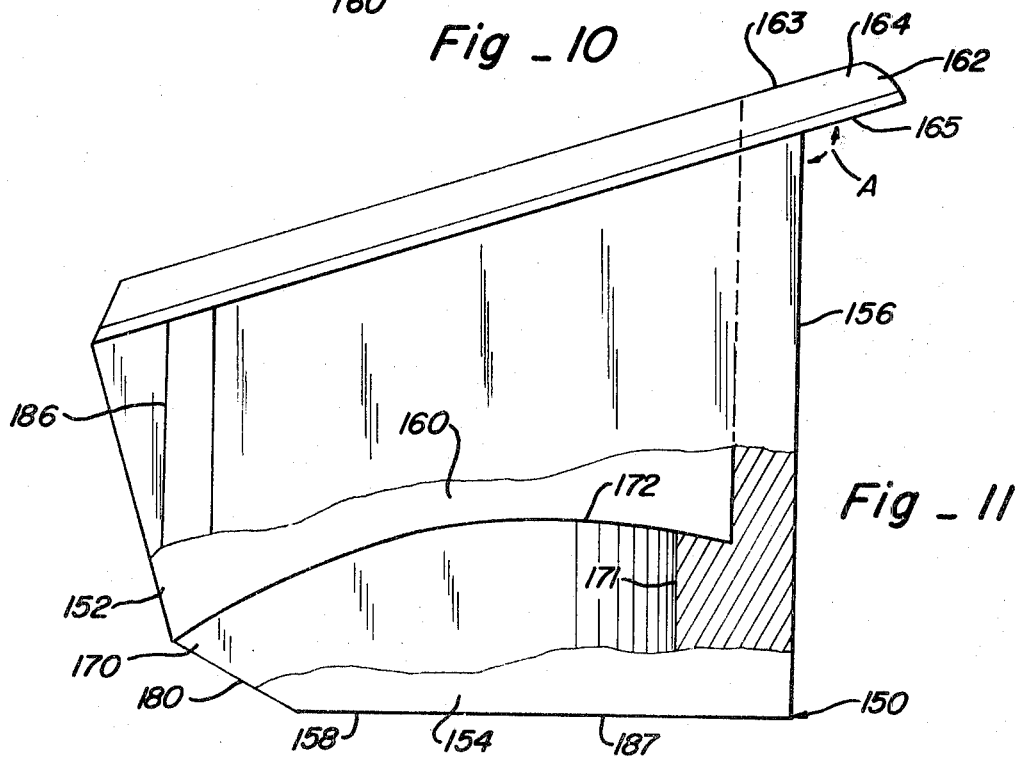
FIG. 11 is a side elevational view, partly in cross-section, of the part of FIG. 10.

Referring now to FIGS. 4, 5, 10 and 11, each of the adjustable limb mounting assembly means 18, 20 comprises a mounting plate member 150 having spaced parallel side wall portions 152, 154 connected by a transverse end wall portion 156 and a bottom wall portion 158 to define a central cavity 160 of generally rectangular peripheral configuration. An outer rim portion 162 having a flat U-shaped outer surface 163 surrounded by an outer tapered peripheral border surface 164, extends outwardly from side wall portions 152, 154 and end wall portion 156 to provide an U-shaped abutment surface 165 therebeneath engageable with the side surface 166 of the inner end portion of the limb members opposite limb surface 48 adjacent an U-shaped slot 167 extending through the inner end portions of the limb members to define spaced parallel limb end flange portions 168, 169. Rim portion 162 and abutment surface 165, FIG. 11, are inclined relative to wall portions 152, 154, 156 at an inclined angle of approximately 105° as indicated at A. An elongated slot 170 is centrally located in bottom wall portion 158 with a closed curved end portion 171 located closely adjacent end wall portion 156 and an opposite open end portion aligned with the opening between side wall portions 152, 154. A convexly curved abutment surface 172 is provided about slot 170 at the bottom of cavity 160 with opposite spaced elongated portions 174, 176 on opposite sides of slot 170 connected adjacent slot end portion 171 by a transverse portion 177 and terminating adjacent the open end portion of slot 170 by intersection with inclined surfaces 178, 180 of bottom wall portion 158. Member 150 is suitably fixedly mounted in limb slot 167 with the outer surfaces of wall portions 152, 154, 156 frictionally and/or adhesively engaged with the side surfaces of limb slot 167 by ribs and grooves 182, 184 in side wall portions 152, 154, and ribs 185, 186 extending outwardly from side wall portions 152, 154. The mounting arrangement is such that the outer surface 187 of the bottom wall portion 158 of member 150 is coplanar with end surface 64 of the limb plate member 65, FIG. 2, and with surface 62 of member 44.

Referring again to FIGS. 4 and 5, assembly means 18, 20 further comprise a flat mounting plate surface 190 on the end portion of handle member 12 having a round semi-circular rib portion 192 extending transversely thereacross at the outer end and a central transverse threaded opening 194 located at the inner end in inwardly spaced relationship to the rib portion 192. A pair of spaced opposite parallel flange members 196, 198 and an end wall portion 200 extending transversely about surface 190 define a limb end receiving cavity 202 thereabout. The mounting arrangement is such that coplanar limb end surfaces 62, 64, 187 may be located in closely spaced relationship to handle end surface 190 with rib portion 192 matingly pivotally supportively received in groove 66 in load bearing relationship therewith.

Figure 4:
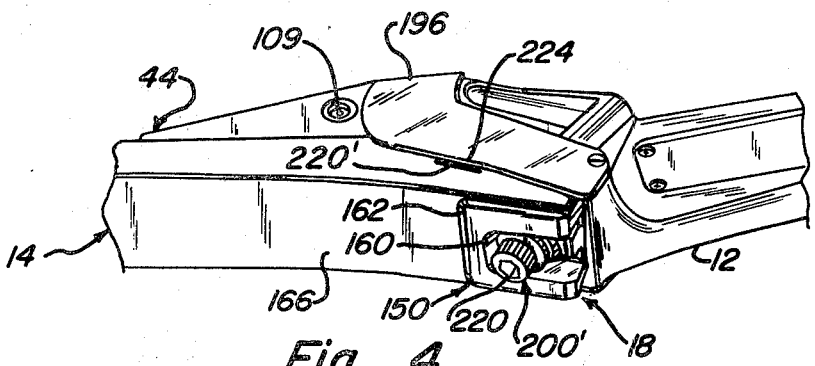
FIG. 4 is an enlarged perspective view of a limb mounting assembly of the bow of FIG. 1.

In order to adjustably secure the limb members on the handle member, a threaded bolt member 200 having a bolt head 202 providing a load bearing shoulder 204 is threadably mounted in threaded bore 194 in association with load bearing means engageable with curved abutment surface 172 of member 150 in the form of a flat thin bearing member 206 of good frictionless material such as Nylon with a curvature corresponding to surface 172 and having a bolt receiving opening 207 and a square rectangular peripheral configuration; an elongated load supporting metallic washer member 208 having a curved inner surface 210 corresponding in curvature to surface 172, a bolt receiving opening 211, a rectangular peripheral configuration generally corresponding to the configuration of cavity 160 so as to be loosely confined therewithin in slidable supportive relationship with surface 172, and an outwardly protruding abutment stop portion 212 limiting movement of the member 208 in the assembled position; a first steel washer member 214 engageable with the outer surface of member 208; a fiber bushing washer member 216; and a second steel washer member 218 engageable such, as shown in FIG. 4, that the bolt member may be tightened against the tension forces of the cables 22, 24 and bow string 42 to obtain load bearing engagement of the end portion of the limb member with the end portion of the handle member. In order to tighten and loosen the bolt member, a polygonal bore 220, adapted to receive a tool such as an Allen wrench, is provided in head portion 202 which in the assembled position is located at least in part within the cavity 160.

Figure 5:
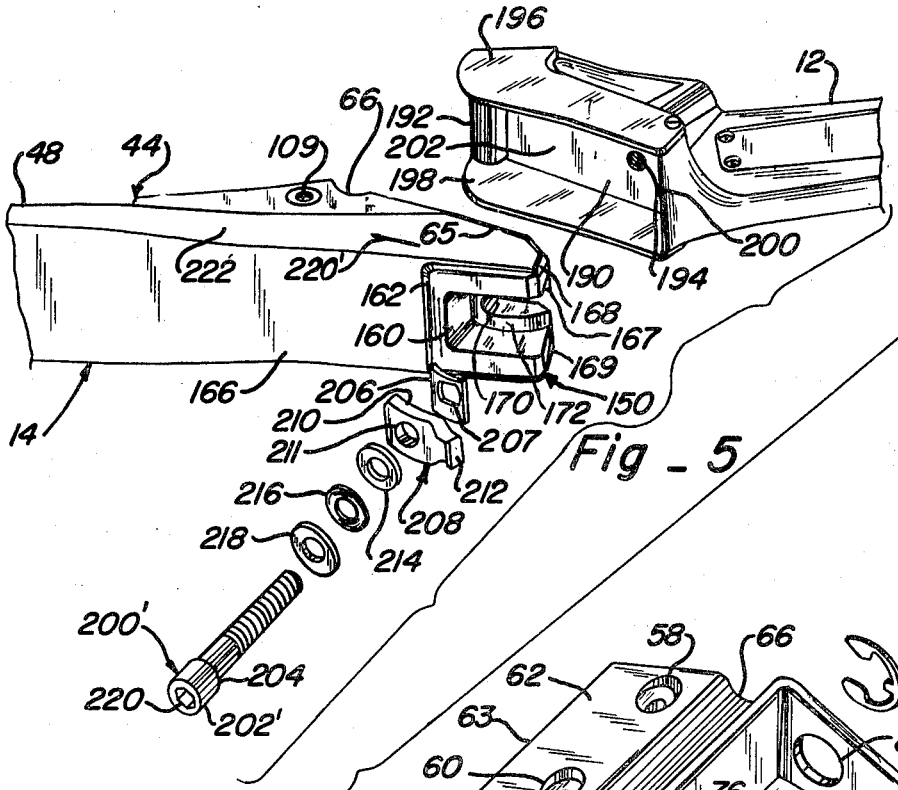
FIG. 5 is an enlarged exploded perspective view of the apparatus of FIG. 4.

The position of the limb member relative to the handle member may be adjustably varied by varying the location of bolt member 200 relative to the limb member in cavity 160 and slot 170. Such adjustment is enabled by slot 66 and rib 192 which provide for pivotal movement of the limb member relative to the handle member and by curved load bearing surfaces 172 and 210 which provide for sliding arcuate movement of the limb member relative to the bolt member. In this manner, the eccentric wheel members 34, 36 on the outer ends of the limb members 14, 16 may be variously uniformly located along arcs having centers at the pivotal axes provided by slots 66 and ribs 172. In order to facilitate adjustment and to provide an initial tuning position for the proper positioning of the bow limbs relative to the bow handle, the bow limbs are initially tested at the factory after manufacture and assembly and a linear mark 220, FIG. 5, is placed on the side surface 222 of the inner end portion of each limb member such that, when the marks are aligned with the outer edges 224 of one of the flange portions, FIG. 4, the bow limbs are in an initial tuned condition of adjustment whereat subsequent equal amounts maintaining a substantially tuned bow condition. The tuning marks are placed on the limb members at a maximum weight pull position whereat the coplanar limb member surfaces 62, 64, 184 have a minimum amount of inclination relative to handle member surface 190. The maximum weight pull obtainable with the particular bow may be positively defined by engagement of surfaces 62, 64, 184 with surface 190 so as to preclude overloading of the bow.

Figure 6:
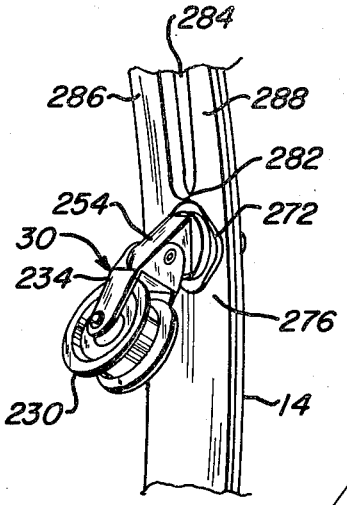
FIG. 6 is an enlarged perspective view of an idler pulley assembly of the bow of FIG. 1.
Figure 7:
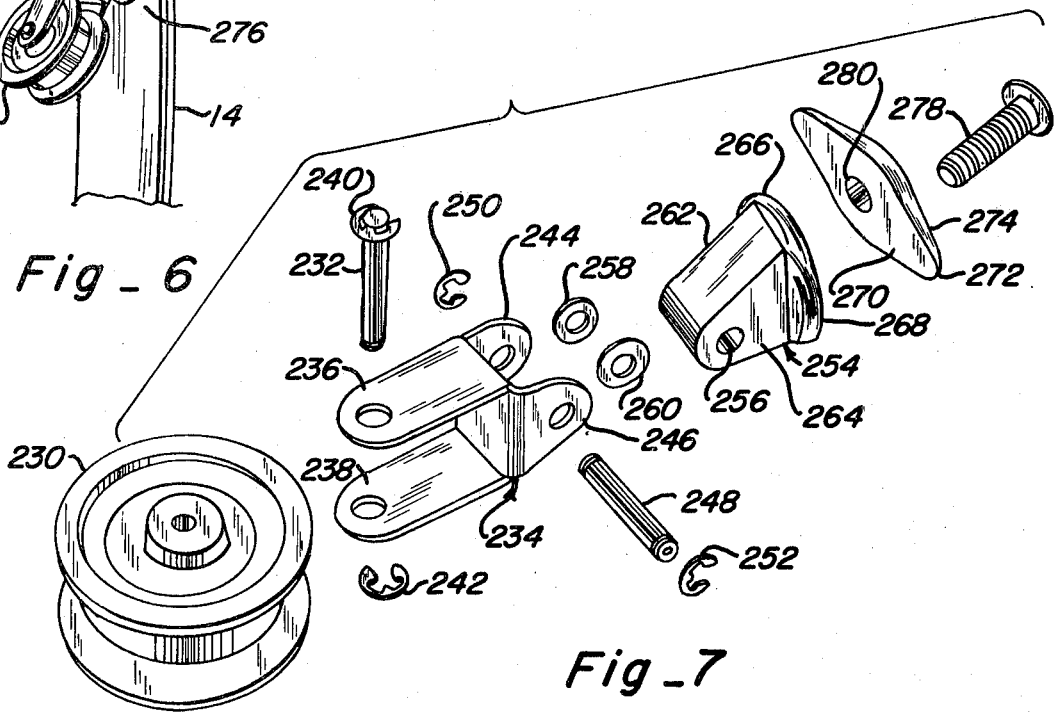
FIG. 7 is an enlarged exploded perspective view of the apparatus of FIG. 6.

Referring now to FIGS. 6 and 7, the cable receiving idler pulley assembly means 30, 32, each comprise an idler pulley wheel member 230 freely rotatably mounted on a pin member 232 supported in a support bracket member 234 between spaced flange portions 236, 238 by retainer ring members 240, 242. A pair of spaced flange portions 244, 246 mount a connecting pin member 248, having an axis transverse to the axis of pin member 232, secured thereto by retainer rings 250, 252. A base member 254 has a transverse bore 256 rotatably supporting pin member 248 with Nylon bearing washers 258, 260 mounted between the side surfaces 262, 264 and flange portions 244, 246. An annular support pad portion 266 on member 254, having an inclined abutment surface 268, abuts flat support surface 270 of a support plate 272 having an inclined limb abutment surface 274 corresponding to the inclination of the adjacent surface 276 of the limb member. A threaded mounting screw 278 extends through a mounting hole in the limb member, through the hole 280 in support plate 272 and into a threaded bore (not shown) in pad portin 266 to hold the pulley assembly on the limb member with the axis of pin member 248 extending generally transversely to the longitudinal axis of the limb member parallel to the adjacent limb surface 276. The bracket member 234 is pivotally supported to enable limited pivotal movement generally parallel to the longitudinal axis of the bow limb member as confined by flange portions 244, 246 and surfaces 262, 264. The pulley member 230 is freely rotatably supported on pin member 232 which provides a variably positionable axis of rotation generally outwardly inclined relative to limb surface 276. The pulley assembly is located relatively closely adjacent the inner end 282 of an elongated slot 284 which extends to the outer end of the limb member to define a pair of spaced parallel finger portions 286, 288, FIG. 8.

Figure 8:
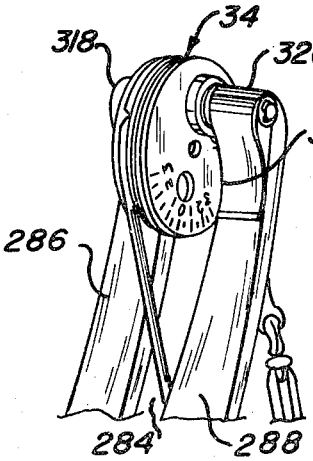
FIG. 8 is an enlarged perspective view of an eccentric wheel assembly of the bow of FIG. 1.
Figure 9:
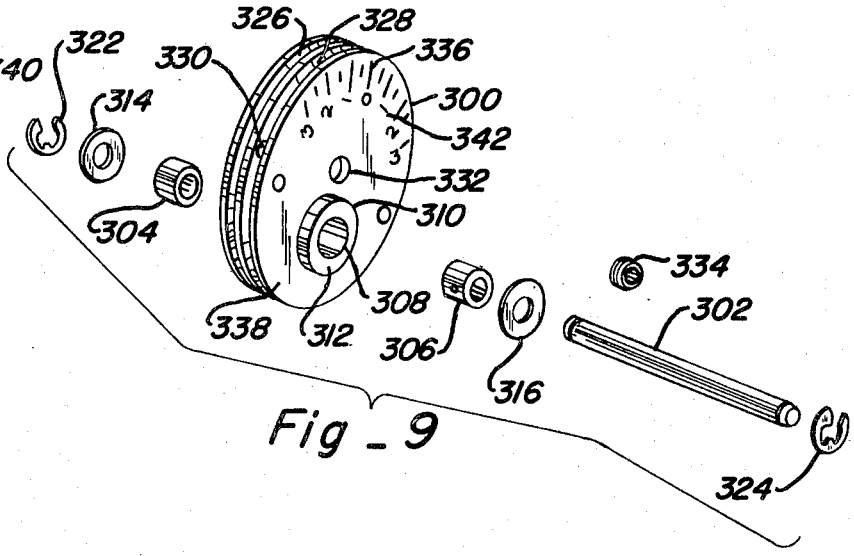
FIG. 9 is an enlarged exploded perspective view of the apparatus of FIG. 8.
Figure 10:
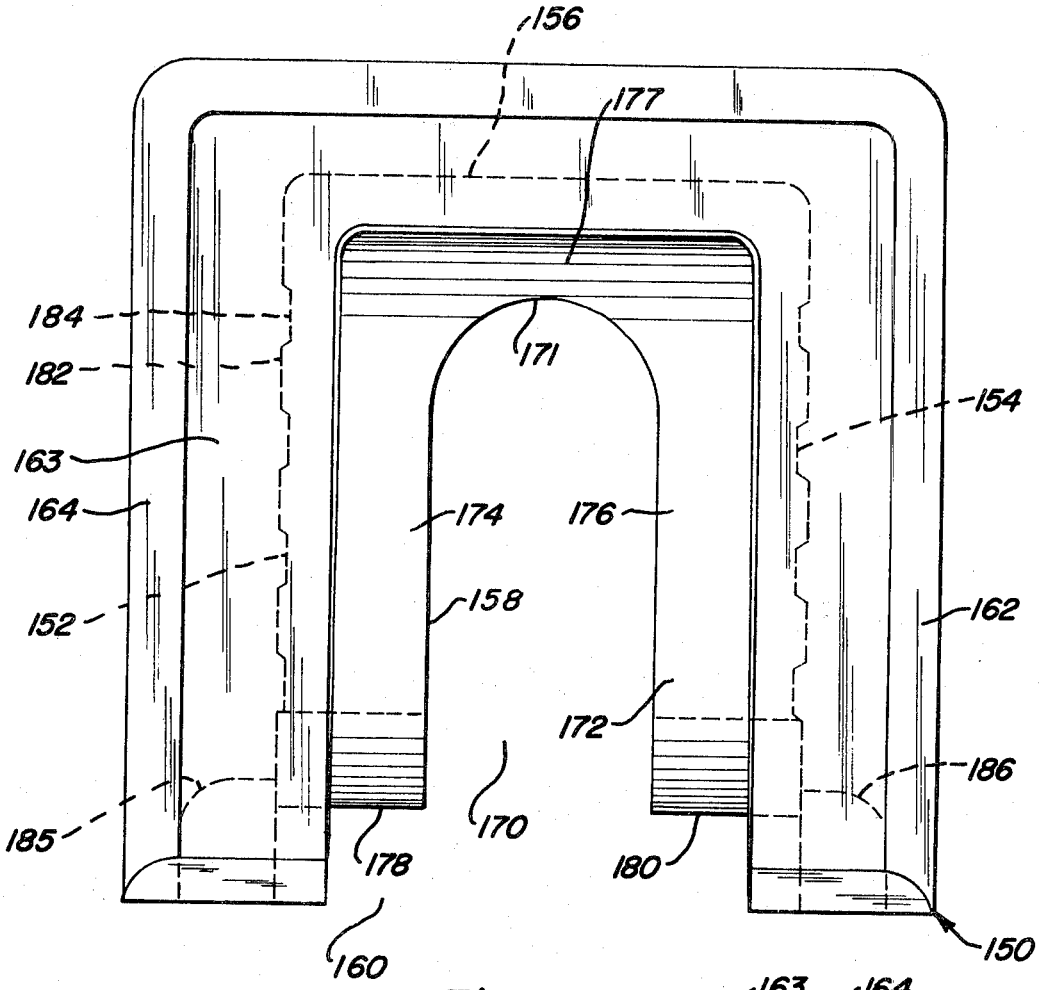
FIG. 10 is an enlarged plan view of one part of the assembly of FIGS. 4 and 5.

Referring now to FIGS. 8 and 9, the cable receiving eccentric wheel means assemblies 34, 36, each comprise an eccentric wheel member 300 rotatably mounted on a pin member 302 by a pair of needle bearing units 304, 306 supported in axial adjacent relationship in a bore 308 in member 300 located in axially offset eccentric relationship to the central axis of the wheel member. A pair of axially protruding bearing housing portions 310 have annular side surfaces 312 adjacent which are mounted thrust washers 314, 316. A pair of shaft bearing members 318, 320 are fixedly mounted on the tips of the limb finger portions 286, 288 and supportively receive the end portions of pin member 302 which are retained therewithin by retainer ring members 322, 324. A pair of annular cable grooves 326, 328 are provided on the periphery of the wheel member 300 with radially extending bore means 330 providing a cable passage connecting the grooves 326, 328. An axially extending threaded bore 332 intersects cable passage 330 and receives a threaded set screw 334 by which the position of the cable relative to the wheel member 300 may be adjustably fixed. As is conventional, a portion of the cable supported in groove 326 and a portion supported in groove 328 are connected by a portion extending through passage 330. A plurality of radially extending linear adjustment marks 336 are provided on the side surface 338 of the wheel member 300 for cooperative association with the adjacent edge 340 of the limb finger portions to provide means for determining the rotational position of the wheel members relative to one another and relative to the limb finger portions. Suitable indicia 342 may be associated with the linear marks 336 such as, for example, numerals extending from a central 0 position to circumferentially oppositely spaced 1, 2, and 3 positions.

In operation, the draw weight of the bow may be adjusted by inserting a tool into socket 220 of adjustment bolt 200 and turning the adjustment bolt. The arrangement is such that every ½ turn of the bolt changes the draw weight by approximately 1 pound. Each bolt of each assembly 18, 20 is to be turned an equal amount so that the draw weight is the same in each limb, the mark on each limb providing a starting position of equal maximum draw weight. In addition, each bow may be calibrated by the manufacturer to provide the purchaser with a chart showing the relationship between the number of half-turns of the bolt members and the decrease in draw weight from the starting position.

The draw length of the bow may be adjusted by winding or unwinding equal lengths of the cable on the shaft portion 85 of each of the assemblies 26, 28, the arrangement being such that ½ turn of the shaft portion 85 results in approximately 1 inch change in draw length. In order to turn shaft portion 85, a suitable tool is inserted in opening 96 and the tool may be used to rotate the member 84 when the ratchet member 100 is is automatically disengaged from the ratchet wheel portion 92 by turning the shaft 84 to wind up the cable or by pressing against surface 138 to enable unwinding of the cable. When the member 84 has been rotated to the desired position, the ratchet member is automatically re-engaged during winding up of the cable or is released and spring 122 returns it to the latched position during unwinding of the cable. If it is desired to replace a cable member, the member 84 is fully unwound and set screw 109 is loosened to enable removal of the end of the cable from bore 108.

In order for a compound bow to function properly, the eccentric wheel members must turn in unison and the amount of eccentricity must be constant. In accordance with the present invention, each bow is tested by the manufacturer and the correct relationship of the timing marks 336 on the eccentric wheel members 300 is noted and that information is supplied to the purchaser of the bow on a specification tag which is attached to the bow. If the position of the timing marks on the eccentric wheel members do not correspond to the specified positions, the relative positions of the wheel members may be adjusted by lengthening or shortening the cable members by rotation of the shaft members 84 as hereinbefore described.

The apparatus of the present invention also enables easy replacement of the various parts and components of the bow and easy tuning of the bow after replacement of parts.

While the inventive concepts have been disclosed herein in an illustrative and present preferred form of the invention, it is contemplated that the inventive concepts may be variously otherwise utilized in alternative forms of the invention and it is intended that the appended claims be construed to include alternative embodiments of the invention except insofar as limited by the prior art.

The invention claimed is:

1. A compound archery bow comprising, an elongated handle portion having a longitudinal axis, a pair of limb portions attached to opposite ends of said handle portion, cable means attached to the bow for propelling an arrow from the bow, wheel means fixedly journaled adjacent the outer end portions of said limb portions for rotatably supporting said cable means for propelling an arrow from the bow, cable attachment means fixedly mounted adjacent the juncture of each said limb portion and handle portion, at least one flange portion on each of said attachment means and having an outer side wall, rotatable shaft means transversely journaled through each said attachment means flange portion and engaging said cable means, said shaft means displaceable to vary the tension upon said cable means to change the draw length of said bow, tool receiving means on one end of said shaft means exposed for access outside said flange portion outer side wall to permit rotary displacement of said shaft means, indicia means on said cable attachment means viewable outside said flange portion outer side wall to signify uniform draw length positions for each said shaft means, and indicia means on said wheel means for signifying uniform rotation during the timing of said wheel means.

2. A compound archery bow according to claim 1 including, ratchet means connected to said shaft means adjacent said flange portion for insuring uniform incremental adjustments in the length of said cable means during displacement of said shaft means.

3. A compound archery bow according to claim 1 wherein, said cable attachment means includes a pair of said flange portions extending generally parallel to the longitudinal axis of said bow, a cable cavity defined by and extending between said flange portions, and said shaft means rotatably supported by both said flange portions and extending across said cable cavity transversely to the longitudinal axis of said bow.

4. A compound archery bow according to claim 3 wherein, one said flange portion is provided with a ratchet cavity communicating with a ratchet wheel on said shaft means within said ratchet cavity, a ratchet dog member within said ratchet cavity adapted to releasably engage and disengage said ratchet wheel, pivot means on said one flange portion supporting said ratchet dog member for pivotal movement between and engaged position with said ratchet wheel to prevent rotation of said shaft means and a disengaged position relative said ratchet wheel to allow rotation of said shaft means, spring means urging said ratchet dog member into engagement with said ratchet wheel, and pressure applying surface means on said ratchet dog member accessible outside said ratchet cavity for applying digital forces to move said ratchet dog member to the disengaged position against the bias of said spring means.

5. A compound archery bow according to claim 3 wherein, said shaft means includes a cable receiving bore extending radially through an intermediate portion thereof and adapted to receive the end portion of said cable means to attach said cable means to said shaft means, an axially extending bore from end of said shaft means intersecting said radially extending cable receiving bore, and a said screw insertable in said axially extending bore for engaging and holding said cable means in said cable receiving bore.

6. A compound archery bow according to claim 1 wherein, said tool-receiving means includes a socket on one end of said shaft means.

7. A compound archery bow according to claim 1 including, pin means for rotatably supporting said wheel means, an elongated slot at the outer end portion of each limb portion, housing means mounted on opposite sides of said elongated slot on the outer end portion of each limb portion for mounting said pin means, hub means in said wheel means for receiving said pin means and needle bearing means in said hub means for rotatably supporting said wheel means on said pin means.

8. A compound archery bow according to claim 7 including, pulley means on the outer end portions of said limb portions for rotatably supporting said cable means about an axis generally outwardly inclined relative to said limb portions, and bracket means mounted on the outer end portions of said limb portions for movably pivotally supporting said pulley means about an axis extending generally transversely to said longitudinal axis to enable variable pivotal displacement of said pulley means relative to said bracket means.

9. A compound archery bow comprising an elongated handle portion having a longitudinal axis, a pair of limb portions attached to opposite ends of said handle portion, cable means attached to the bow for propelling an arrow from the bow, wheel means on the outer end portions of said limb portions for rotatably supporting said cable means, draw string means attached to said cable means for propelling an arrow from the bow, a pair of rotatable shaft means for attaching and for winding and unwinding said cable means to change the draw length of said bow, pulley means on the outer end portions of said limb portions for rotatably supporting said cable means about an axis generally outwardly inclined relative to said limb portions, bracket means mounted on the outer end portions of said limb portions for movably pivotally supporting said pulley means about an axis extending generally transversely to said longitudinal axis to enable variable pivotal displacement of said pulley means relative to said bracket means, said bracket means including, a pad member fixedly mounted on said limb portions, an inclined surface on said pad member abutting said limb portions, a flat mounting surface on said pad member opposite said inclined surface, a pivot arm member fixedly mounted on said pad member, a flat abutment surface on said pivot arm member abuttingly engaging said flat mounting surface on said pad member, a pair of spaced flat parallel side surfaces on said pivot arm member extending generally parallel to side surfaces on said pivot arm member and extending generally parallel to said longitudinal axis and outwardly relative to said flat abutment surface, a first pivot pin mounted in said pivot arm member and extending generally transversely to said longitudinal axis through and beyond said side surfaces, a bracket member pivotally mounted on said first pivot pin, a first pair of parallel spaced flange portions on said bracket member extending generally parallel to said side surfaces and pivotally mounted on said pivot pin, a second pair of parallel spaced flange portions on said bracket member extending generally transversely to said first pair of parallel spaced flange portions, a second pivot pin mounted on and extending transversely between said second pair of parallel spaced flange portions, and said pulley means being rotatably mounted on said second pivot pin.

* * * * *